US008986170B2

(12) United States Patent
Sherstnev et al.

(10) Patent No.: US 8,986,170 B2
(45) Date of Patent: Mar. 24, 2015

(54) SWIM TRAINING AID APPARATUS

(75) Inventors: Eduard Y. Sherstnev, El Cerrito, CA (US); Gavin B. Lee, El Cerrito, CA (US)

(73) Assignee: Aquavolo LLC, El Cerrito, CA (US)

( * ) Notice: Subject to any disclaimer, the term of this patent is extended or adjusted under 35 U.S.C. 154(b) by 516 days.

(21) Appl. No.: 13/207,259

(22) Filed: Aug. 10, 2011

(65) Prior Publication Data

US 2012/0053021 A1 Mar. 1, 2012

Related U.S. Application Data

(60) Provisional application No. 61/377,451, filed on Aug. 26, 2010.

(51) Int. Cl.
*A63B 31/00* (2006.01)
*A63B 69/12* (2006.01)
*A63B 21/008* (2006.01)

(52) U.S. Cl.
CPC ..... *A63B 69/12* (2013.01); *A63B 21/0084* (2013.01); *A63B 31/00* (2013.01)
USPC ..... 482/55

(58) Field of Classification Search
CPC ..... A63B 69/12; A63B 21/0084; A63B 2208/003; A63B 2225/60
USPC ..... 482/51, 55–56, 148, 74, 79, 92, 111, 482/131, 139; 383/42, 59, 60–99, 100–103, 383/41; 434/247, 254; 441/60–64; 2/16, 20, 2/69.5, 88, 162, 170, 129, 141.1, 202
See application file for complete search history.

(56) References Cited

U.S. PATENT DOCUMENTS

| | | | | | |
|---|---|---|---|---|---|
| 1,033,066 | A | * | 7/1912 | Freedman | 2/221 |
| 1,192,650 | A | * | 7/1916 | Leitner | 441/60 |
| 1,550,542 | A | * | 8/1925 | Haines | 441/60 |
| 1,695,125 | A | * | 12/1928 | Rensing | 441/60 |
| 1,706,330 | A | * | 3/1929 | Sorg | 383/75 |
| 1,779,590 | A | * | 10/1930 | Eilers | 441/60 |
| 1,827,308 | A | * | 10/1931 | Dorris | 441/60 |
| 2,323,318 | A | * | 7/1943 | Farkas | 43/55 |
| 2,445,487 | A | * | 7/1948 | Lester et al. | 2/174 |
| 3,344,449 | A | * | 10/1967 | Grilli | 441/60 |
| 3,475,767 | A | * | 11/1969 | Friesen et al. | 4/452 |
| 4,067,066 | A | * | 1/1978 | Bruno | 2/105 |
| 4,302,007 | A | | 11/1981 | Oprean et al. | |
| 4,804,326 | A | * | 2/1989 | Lennon | 434/254 |
| 4,813,668 | A | | 3/1989 | Solloway | |
| 4,889,510 | A | | 12/1989 | Piatt | |
| 4,944,393 | A | * | 7/1990 | Cappuzzo et al. | 206/205 |
| 4,948,385 | A | | 8/1990 | Hall | |
| 4,979,833 | A | * | 12/1990 | Cook | 383/12 |
| 4,997,183 | A | | 3/1991 | Winston | |
| 5,006,380 | A | * | 4/1991 | Fraser | 428/35.2 |
| 5,050,999 | A | * | 9/1991 | Van Loon, III | 383/76 |

(Continued)

*Primary Examiner* — Loan H Thanh
*Assistant Examiner* — Andrew S Lo
(74) *Attorney, Agent, or Firm* — Beyer Law Group LLP

(57) ABSTRACT

A swim training aid apparatus is provided for use on a limb of a swimmer, during a swimming motion. The training aid includes a flexible band member configured to extend circumferentially around the limb, and a lock device cooperating with the band member to releasably retain the same around the swimmer's limb. The training aid further includes a substantially non-absorbent, flexible material sheath having one end thereof mounted to the band member, and an opposite end thereof extending distally past and terminating beyond the limb.

2 Claims, 6 Drawing Sheets

(56) References Cited

U.S. PATENT DOCUMENTS

| | | | | | |
|---|---|---|---|---|---|
| 5,078,508 | A | * | 1/1992 | Johan et al. | 383/75 |
| 5,098,754 | A | * | 3/1992 | Horstmyer | 428/35.2 |
| 5,101,513 | A | * | 4/1992 | Bowers | 2/84 |
| 5,219,317 | A | | 6/1993 | Beasley | |
| 5,238,305 | A | * | 8/1993 | Feller | 383/22 |
| 5,238,307 | A | * | 8/1993 | Mooney et al. | 383/74 |
| 5,242,321 | A | * | 9/1993 | Gil | 441/64 |
| 5,259,798 | A | * | 11/1993 | Runckel | 441/64 |
| 5,288,150 | A | * | 2/1994 | Bearman | 383/38 |
| 5,323,802 | A | * | 6/1994 | Kiedrowski | 135/34.2 |
| 5,490,619 | A | * | 2/1996 | Boyar | 224/153 |
| 5,618,110 | A | * | 4/1997 | Sullivan | 383/4 |
| 5,667,466 | A | | 9/1997 | Riley, Jr. | |
| 5,688,052 | A | * | 11/1997 | Compton | 383/38 |
| 5,700,173 | A | | 12/1997 | Lerro | |
| 5,913,592 | A | | 6/1999 | Moore | |
| 5,980,108 | A | * | 11/1999 | Pasbrig | 383/75 |
| 5,988,879 | A | * | 11/1999 | Bredderman et al. | 383/13 |
| 6,003,717 | A | * | 12/1999 | Long | 220/495.11 |
| 6,019,244 | A | * | 2/2000 | Jones | 220/666 |
| 6,050,726 | A | * | 4/2000 | Hoerl | 383/127 |
| 6,086,253 | A | * | 7/2000 | Hartsfield | 383/22 |
| 6,092,932 | A | * | 7/2000 | Pekala et al. | 383/75 |
| 6,264,391 | B1 | * | 7/2001 | Kroha | 401/201 |
| 6,267,524 | B1 | * | 7/2001 | Kroha | 401/201 |
| 6,274,181 | B1 | * | 8/2001 | Richison et al. | 426/118 |
| 6,398,410 | B1 | * | 6/2002 | Guerra | 383/24 |
| 6,711,752 | B2 | * | 3/2004 | Smith | 2/422 |
| 6,726,362 | B1 | * | 4/2004 | Frisch et al. | 383/103 |
| 6,939,463 | B2 | * | 9/2005 | Leaverton | 210/167.12 |
| 6,979,241 | B2 | | 12/2005 | Hull | |
| 7,128,698 | B2 | | 10/2006 | Shifferaw | |
| 7,163,495 | B2 | | 1/2007 | Fazio et al. | |
| 7,435,149 | B2 | | 10/2008 | Bastiao | |
| 7,596,930 | B2 | * | 10/2009 | Borchardt | 53/434 |
| 7,794,364 | B2 | | 9/2010 | Killgore et al. | |
| 2003/0077007 | A1 | * | 4/2003 | Turvey et al. | 383/33 |
| 2003/0202718 | A1 | * | 10/2003 | Tomic | 383/64 |
| 2005/0249439 | A1 | * | 11/2005 | Penson | 383/38 |
| 2006/0126969 | A1 | * | 6/2006 | Paller | 383/38 |
| 2007/0110340 | A1 | * | 5/2007 | Buchman | 383/5 |
| 2008/0161167 | A1 | * | 7/2008 | Ottaviani | 482/55 |
| 2008/0178364 | A1 | * | 7/2008 | Brickle et al. | 2/69.5 |
| 2009/0129705 | A1 | * | 5/2009 | Simonson et al. | 383/22 |
| 2009/0190865 | A1 | * | 7/2009 | Chang | 383/110 |
| 2009/0202182 | A1 | * | 8/2009 | Pinto et al. | 383/71 |
| 2010/0107297 | A1 | | 5/2010 | Brodbeck | |
| 2010/0172601 | A1 | * | 7/2010 | Lin | 383/41 |
| 2011/0009244 | A1 | | 1/2011 | Killgore et al. | |

* cited by examiner

SWIM TRAINING AID APPARATUS

RELATED APPLICATIONS

This application claims priority under 35 U.S.C. §119(e) from U.S. Provisional Patent Application No. 61/377,451, filed Aug. 26, 2010, entitled "KICKING DEVICE FOR SWIMMERS," naming Eduard Sherstnev as the inventor, and which is incorporated herein by reference in its entirety and for all purposes.

FIELD OF THE INVENTION

The present invention relates to athletic training devices, and more particularly, relates to competitive swimmers' training apparatus.

BACKGROUND OF THE INVENTION

In the field of competitive swimming, it has been recognized that the development of strength and endurance of one's swimming muscles is one of the keys for success and speed, when training. While weight lifting is still an important training technique, this lifting exercise alone will not adequately develop all the muscles utilized in a swimming stroke, let alone increasing one's endurance.

As a consequence, various swim training aids have been developed that increase the water resistance experienced by a swimmer's limb during a swim stroke. Such increased water resistance proportionately develops all the swimming muscles, as well as their endurance. Typical of such swim training gear include drag suits, parachutes, power towers, fins or stretch cords that are attached to the swimmer during the swimming training sessions.

While these swim training aids do increase water resistance, with varying degrees of success, they all have their significant drawbacks. For example, many of these devices are cumbersome and uncomfortable to use. Others are difficult to put on, especially under water, and inhibit a swimmers' technique. Still others are expensive, and of limited use.

Accordingly, there is a need to provide a swim training aid that increases the water resistance experienced by the swimmer's limbs, and that proportionately builds strength and endurance while swimming, yet is affordable, comfortable to use, easy to put on, and permits freedom of the swimmer's movement so that their swimming technique is not compromised.

SUMMARY OF THE INVENTION

The present invention provides a swim training aid for use on a limb of a swimmer, during a swimming motion. The training aid includes a flexible band member configured to extend circumferentially around the limb, and a lock device cooperating with the band member to releasably retain the same around the swimmer's limb. The training aid further includes a substantially non-absorbent, flexible material sheath having one end thereof mounted to the band member, and an opposite end thereof extending distally past and terminating beyond the limb.

Accordingly, during the swimming motion, the flexible, yet porous, material increases the water resistance experienced by the swimmer, improving their endurance and developing their swimming muscles, yet can be worn comfortable on the swimmer's limb and can be operated without negatively inhibiting the swimmer's technique.

In one specific embodiment, the flexible material sheath is provided by a porous mesh material, which for example, is composed of polyester material.

In yet another configuration, the mesh material includes substantially uniform sized area apertures therethrough, while in still other specific embodiments, the mesh material includes at least two different sized area apertures. By adjusting the size of the apertures, the water resistance can be adjusted.

In still another embodiment, the shape and length of the flexible material sheath may be altered to further customize the water resistance experienced by the swimmer. For instance, in one configuration, the flexible material sheath is generally frusto-conical shell shaped, while in another, the flexible material sheath is generally frustum-conical shell shaped. Yet still another embodiment provides the flexible material sheath with a plurality of elongated material strands oriented in a side-by-side manner.

As mentioned above, the length of the flexible material sheath can also be altered to adjust the water resistance experienced by the user. Generally, however, the length of the flexible material sheath from a distal end portion thereof to the flexible band member is in the range of about 12 inches to about 36 inches.

Still another specific embodiment to adjust the water resistance is by providing an adjustment device that is mounted to the flexible material sheath. Such adjustment device is operable to one of selectively increase and decrease the drag caused by the flexible material sheath on the limb of the swimmer during the swimming motion.

In another specific embodiment, the flexible band material is resilient. More specifically, for instance, the band material may be provided by a resilient tubing material.

Yet another configuration provides a lock device for the band material which includes a plate member defining a pair of receiving channels extending therethrough. Each receiving channel is diametrically sized for snug sliding receipt of a transverse cross-sectional dimension of the tubing material, in a longitudinally tensioned condition, and for frictional retainment thereof, in a non-longitudinally tensioned condition.

In another aspect of the present invention, an alternative embodiment swim training aid apparatus is provided for use on a limb of a swimmer, during a swimming motion. This embodiment includes a flexible band member configured to extend circumferentially around the limb for retainment thereof, and a substantially non-absorbent, flexible, porous mesh material. One end thereof is mounted to the band member, and an opposite end of the mesh material extends distally past and terminating beyond the limb when the swimmer is swimming such that the flexible mesh material increases the water resistance experienced on the limb of the swimmer during the swimming motion.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
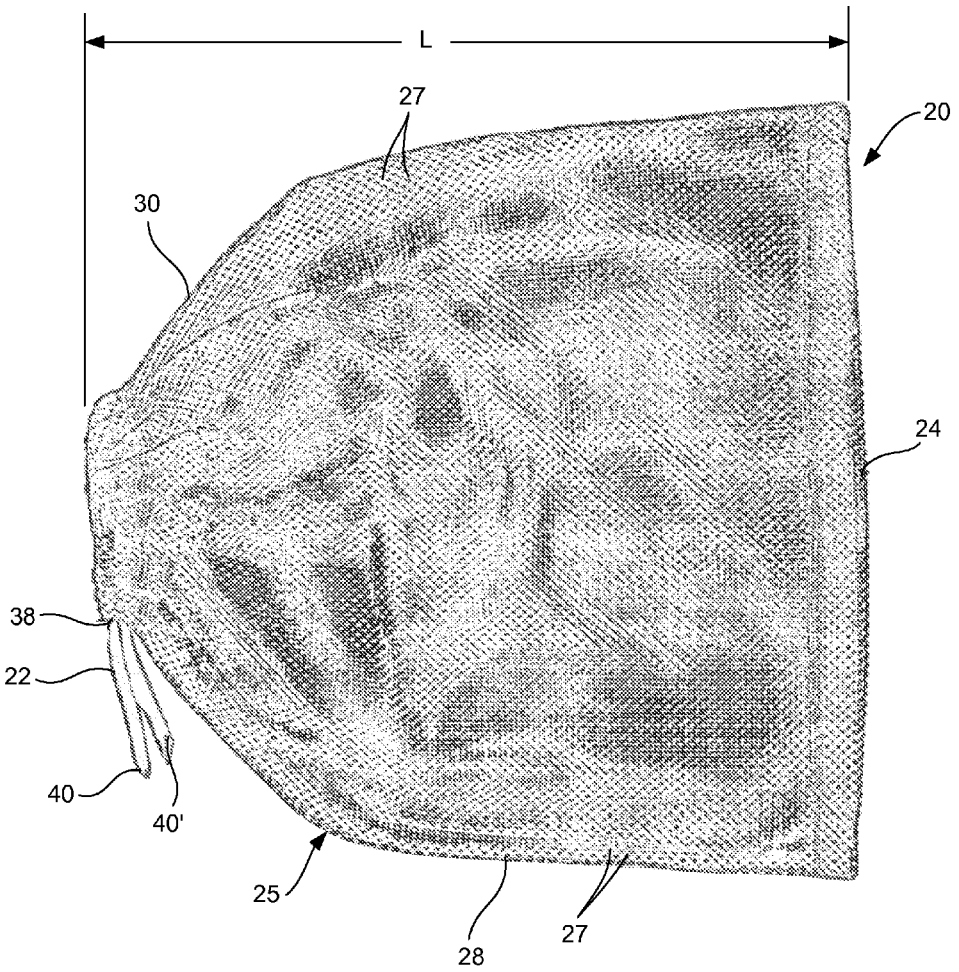
FIG. 1 is a side elevation view of a swim training aid apparatus, in a flattened state, constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
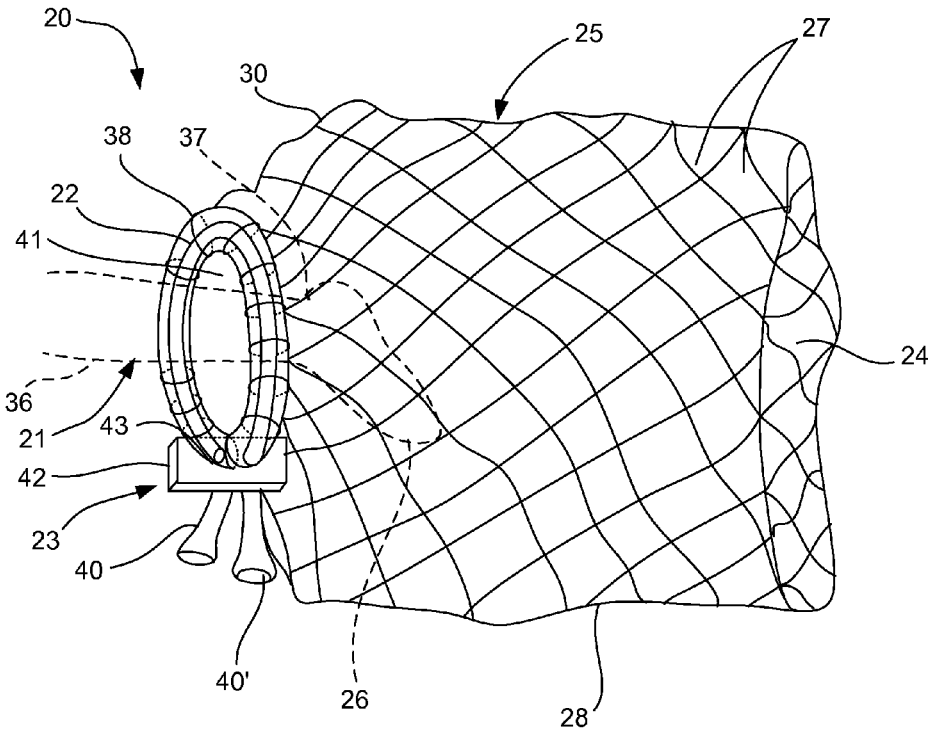
FIG. 2 is a side perspective view of the swim training aid apparatus of FIG. 1, shown with a flexible band member therewith in an extended condition while a user's foot is positioned therethrough.

Referring now to the embodiment of FIGS. 1 and 2, a swim training aid apparatus, generally designated 20, is illustrated for use on a limb 21 of a swimmer, during a swimming motion. The training aid apparatus 20 includes a flexible band member 22, configured to extend circumferentially around the limb 21, and a lock device, generally designated 23, that is configured to cooperate with the band member 22 to releasably retain the same around the swimmer's limb 21. In accordance with the present invention, the training aid apparatus includes a substantially non-absorbent, flexible material sheath 25, having one end thereof mounted to the band member 22, and an opposite end thereof extending distally past and terminating beyond the swimmer's limb 21.

Accordingly, during the swimming motion, the flexible material sheath 25 waves up and down (or side to side, or back and forth), increasing the drag acting upon the swimmer's limb (i.e., increases the water resistance experienced by the swimmer). Depending upon the amount of drag created, and the length and duration of the swimmer's training, etc., the swimmer's endurance and proportional development of their swimming muscles can be dramatically improved. Unlike most of the current swim training aid designs, however, the present inventive swim training aid can be worn comfortable on the swimmer's limb, and be operated without negatively impacting the swimmer's technique.

The flexible material sheath 25, in accordance with the present invention, preferably extends perimetrically around a majority (i.e., at least 51%) of the swimmers limb, and is of a length, L, between the band member 22 and a distal end of thereof, in the range of about twelve (12) inches to about thirty-six (36) inches. Since the flexible material sheath is formed and dimensioned to extend distally past the user's limb (preferably the foot 26), during a swimming motion, such as freestyle kicking, the flexible nature of the material causes the flexible sheath to wave up and down (or side to side) like waving a flag or towel in the air. Resistance is created in the water by friction, as the water is pulled apart against its cohesive forces in order to make room for the flexible sheath. The sheath pulls apart the water in such a way as to force it into eddies and other unevenness of motion, thus multiplying the energy needed for propulsion.

It is desirable for the flexible material sheath 25 to be both non-absorbent and porous. A flexible non-absorbent material, such as polyester or nylon, will not significantly increase in weight when placed in water, due to its non-absorbent nature. Moreover, the porous flexible material sheath preferably contains a uniform distribution of flow-through apertures 27, as best viewed in FIGS. 1 and 4, across it surface which is capable of generally allowing the uniform flow of water therethrough. An example of such a material would be a polyester or nylon mesh material, such as those provided by Stanek Netting Co., Inc.

Moreover, such a flexible material sheath 25 is significantly more comfortable to wear and operate, both in and out the water, and the prospect of entanglement during the swimming motion is virtually non-existent. Thus, in comparison to the existing swim training aids, the present invention can be worn prior to water entry, facilitating the ease of attachment, and can and be operated without negatively impacting the swimmer's technique.

In accordance with the present invention, by altering the size and distribution of the apertures, as well as the shape of the flexible material sheath and the length thereof, the water resistance experienced by each swimmer's limb, during the swimmer's motion, can be customized to a particular swimmer's needs.

Figure 5:
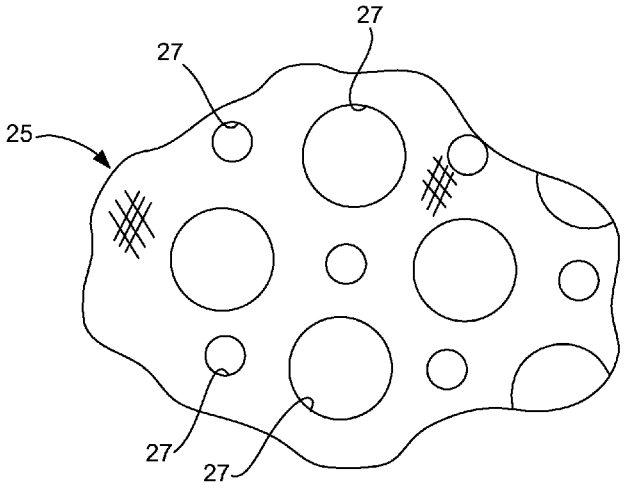
FIG. 5 is an enlarged, top plan view of an alternative embodiment aperture pattern for a material sheath of the training aid apparatus of FIG. 1.
Figure 6A:
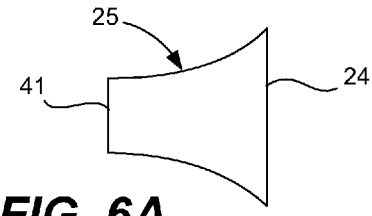
FIGS. 6A-6G are side elevation views of alternative embodiment material sheath patterns for the training aid apparatus of FIG. 1.
Figure 6B:
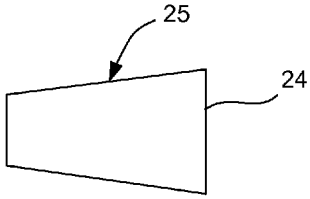
Figure 6C:
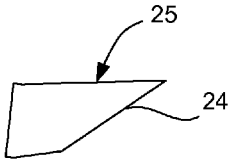
Figure 6D:
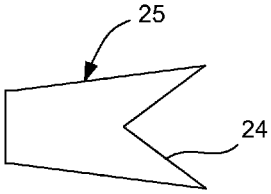
Figure 6E:
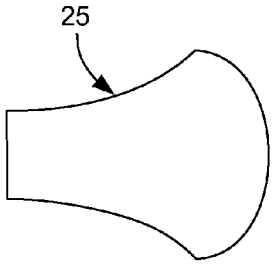
Figure 6F:
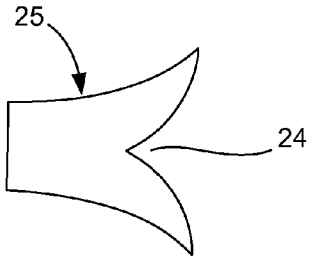
Figure 6G:
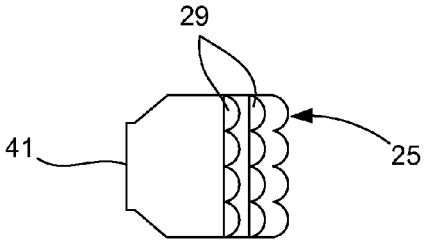

In general, the smaller the diameter of the flow-through apertures 27, the greater the experienced water resistance, via the material sheath. On the other hand, a greater number of apertures, given the same diameter thereof, would lessen the experienced water resistance since the water flow through will be proportionately increased. In still another embodiment, the flexible mesh material may be provided that is configured to have two or more different diameter apertures 27 (FIG. 5) for even greater customized training fit for a particular swimmer.

By way of example, accordingly, two flexible mesh material sheaths that are substantially similarly sized and dimensioned, could have different sized aperture diameters and different distribution lay-outs, but could be designed to have substantially similar water resistant characteristics.

Another factor in changing the water resistance characteristics experienced by the swimmer is altering the shape of the flexible material sheath 25. Thus, changing the shape of the material sheath 25, as well as its length, L, is yet another factor that can be applied to customize the water resistance characteristics experienced by the swimmer during operation. Generally, the wider and longer the material sheath 25, the greater the water resistance characteristics thereof. More generally, the shape of the sheath can be altered, increasing or decreasing its total surface area, respectively increasing or decreasing the resulting water resistance experienced.

Figure 4:
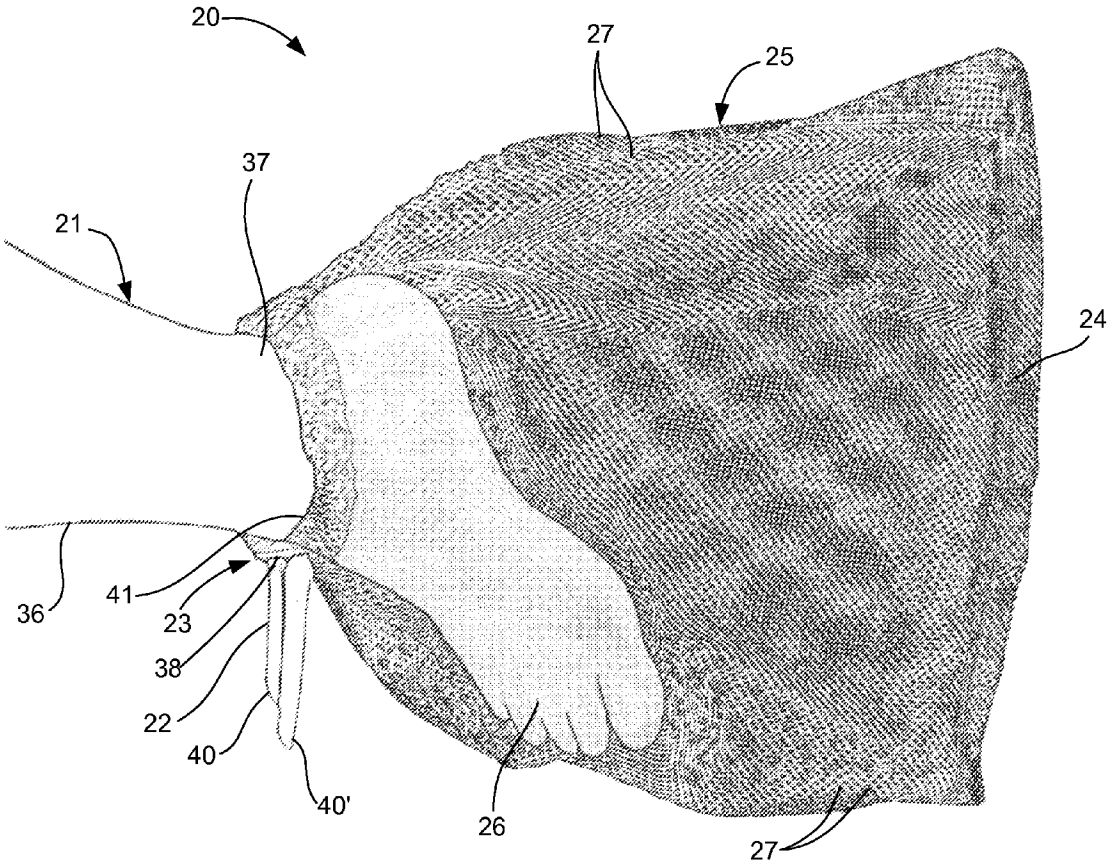
FIG. 4 is a side perspective view of the swim training aid apparatus of FIG. 2, shown with a flexible band member therewith a retracted condition while a user's foot is positioned therethrough.

In its most basic form, as best viewed in FIGS. 1, 2 and 4, the material sheath 25 includes a substantially cylindrical portion 28, and a proximal tapered portion 30 that tapers inwardly until it is mounted to the band member 22. Preferably, the diameter of the cylindrical portion 28 is in the range of about six (6) inches to about thirty-six (36) inches. The length, L, of the material sheath, as above mentioned, is generally in the range of about twelve (12) inches to about thirty-six (36) inches in length. However, this length, L, can be shorter or longer depending upon the desired water resistance to be experienced.

FIGS. 6A-6G best illustrate a few alternative material sheath 25 embodiments. For instance, the material sheath 25 may be generally bell bottom shell-shaped (FIG. 6A) or frustum-conical shell-shaped (FIG. 6B) both of which provide a wider distal sheath portion for increased drag. Other alternative sheath designs, for example, include an asymmetrical conical-shell shape (FIG. 6C) that provides a larger distal opening 24 to accommodate swimming fins or the like, or a generally flared distal sheath portion with a V-cut portion (FIGS. 6D and 6F) resulting in a slightly reduced drag coefficient. The scalloped design of FIG. 6G, in comparison, incorporates a plurality of scalloped drag pockets 29 configured to increase drag.

Figure 7A:
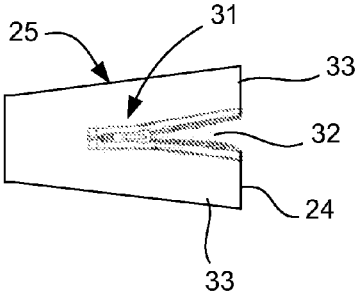
FIGS. 7A and 7B are side elevation views of alternative embodiment material sheath incorporating an adjustment device for the training aid apparatus of FIG. 1.
Figure 7B:
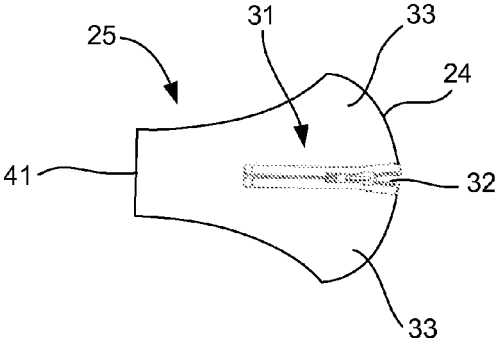

Referring now to FIGS. 7A and 7B, a water resistance adjustment device 31 may be incorporated with the flexible material sheath 25 that enables the user to selectively increase or decrease the experienced water resistance during the swimming motion. In general, the adjustment device 31 alters the amount of water flow through the training aid apparatus thus, adjusting the collective water resistance.

For example, at least the distal portion of the material sheath 25 may incorporate one or more longitudinally extending slits 32 that effectively separate the sheath distal portions into two or more independent sections 33 (FIGS. 7A and 7B). This effectively reduces the material sheath's water resistance capabilities, when the distal sections are separated, such as when the adjustment device 31 is in a released condition, as shown in FIG. 7A. When the adjustment device 31 is selectively positioned to an engaged condition, as best illustrated in FIG. 7B, the adjacent distal sections 33 can be reattached to one another, thus increasing the sheaths collective water resistance.

To fasten these sheath distal sections 33 to one another, the adjustment device 31 may include any type fastener. For example, conventional fasteners such as a zipper, snap fasteners, buttons, and hook and loop fasteners may be employed.

Figure 8:
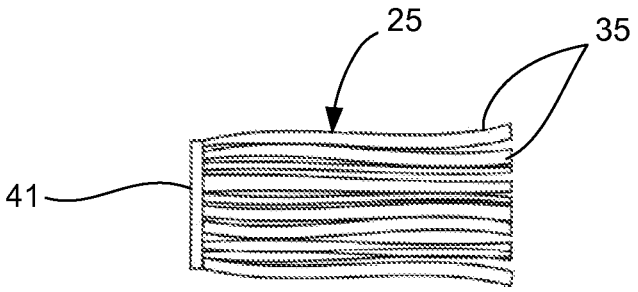
FIG. 8 is a side elevation view of alternative embodiment material sheath incorporating a plurality of strands for the training aid apparatus of FIG. 1.

As another alternative embodiment, the flexible material sheath 25 can be provided by a plurality of adjacent, elongated, material strands 35 each independent of on another (FIG. 8). A proximal end of each strand 35 is mounted to the flexible band member 22, while the respective distal ends thereof freely move or flap relative to one another.

Turning now to FIGS. 2-4 and 9, the manner in which the swim training aid apparatus 20 is easily mounted to swimmer's limb will now be described in detail. Briefly, it will be appreciated that while the swim training aid apparatus 20 of the present invention may be mounted to any limb of a swimmer, this aid is particularly suitable for use on the legs of a swimmer. Accordingly, the mounting of the training aid apparatus will now be described with respect to the swimmer's legs 36, ankles 37 and feet 26 for illustrative purposes.

To facilitate releasable mounting to a leg 36 of the swimmer, as above indicated, the training aid apparatus 20 includes a flexible band member 22 that is configured to extend circumferentially around the swimmer's ankle 37, just above their talus (FIGS. 2 and 4). The band member 22 is preferably provided by a resilient elongated rope or cord material upon which the proximal end portion of flexible material sheath 25 is coupled to. Briefly, any form of coupling of the material sheath to the band member 22 may be employed. For example, the band member 22 may be fixedly attached to the flexible material sheath. Preferably, however, the proximal portion of the sheath 25 merely extends over the band member 22, and onto itself where the proximal edge portion of the sheath may be adhered or sewn to itself just below the edge portion.

Collectively, a sufficiently sized receiving passage 38 (FIGS. 2 and 3) is formed at the proximal portion thereof for sliding receipt of the band member therethrough. By coupling the end portions 40, 40' of the band member 22 together, via the lock device 23, a proximal opening 41 into the material sheath 25 is formed that can be diametrically size adjusted in a draw string type manner. This enables the flexible band member 22 to be slideably received in the receiving passage 38 so that the opening 41 can be comfortably adjusted around the swimmer's ankle 37, and as mentioned, just above their talus, wherein the diameter of the proximal opening may be releasably retained by the lock device.

Once the diametric proximal opening 41 of the sheath 25 has been initially adjusted, the resiliency of the band member 22 enables the user to subsequently easily mount and dismount the swim training aid by simply stretching the band member 22. For instance, during mounting, the band member 22 may be stretched to enlarge the proximal opening by a sufficient amount so that the band member can be slid past the user's foot 26 and wide portion of their ankle 37 (e.g., the talus) (FIG. 2). Subsequently, the resiliency of the band member 22 contracts the band back to its normal state around the swimmer's ankle (FIG. 4). Accordingly, the flexible band member 22 is very easy to extend in order to place around a limb and retract sufficiently for retainment around the swimmer's ankle, and yet offer comfort during use.

The flexible band member 22 is preferably provided by a resilient rubber or silicon material. While the band member 22 can be solid rubber or other elastic material, as well as that comprised of multiple strands, conventional rubber tubing is preferable. A larger diameter band member 22 can then be utilized for operational comfort, while at the same time reducing its weight and easing its ability to stretch when being fitted on the limb (as compared to a similar diameter solid band material). In one specific embodiment, a suitable rubber may be applied having a diameter in the range of about ⅛ in. to about 1 in., such as conventional rubber surgical tubing.

Other conventional resilient bands can be substituted such as bungee-style cords or rubber bands. Moreover, non-resilient band member can also be utilized such as conventional ropes, cords, etc. However, such an application may increase the difficulty of fitting of the training aid.

Figure 3:
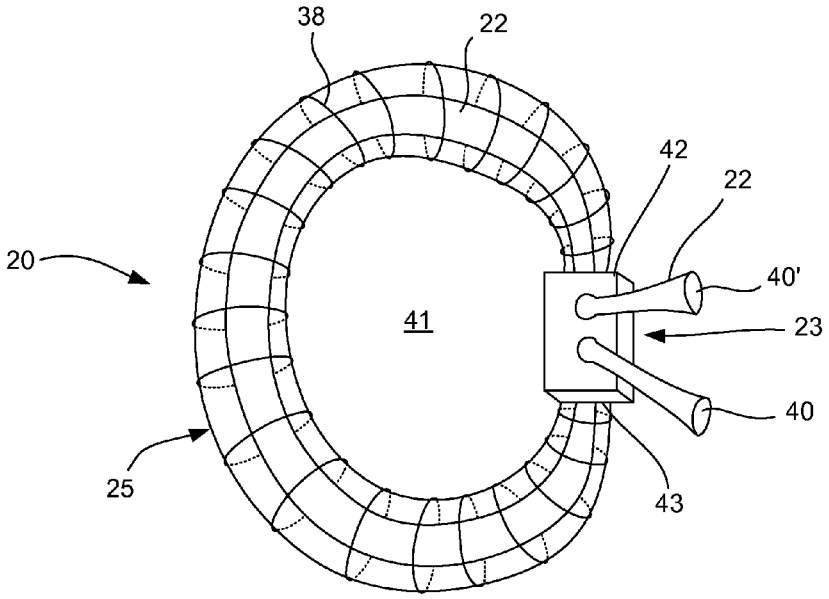
FIG. 3 is an enlarged, front elevation view of the swim training aid apparatus and flexible band member of FIG. 2.
Figure 9:
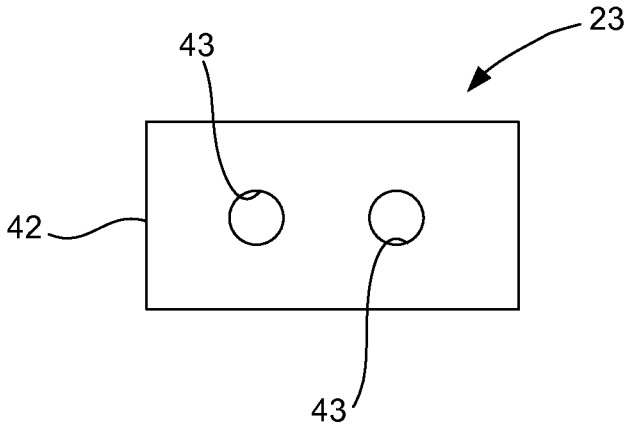
FIG. 9 is an enlarged, top plan view of a locking device for the flexible band member swim training aid apparatus of FIG. 1.

Referring now to FIGS. 3 and 9, the lock device 23 is configured to cooperate with the band member 22 to releasably retain the same around the swimmer's limb 21, such as their ankle. Essentially, the lock device 23 prevents slippage of the flexible band member 22 therethrough, retaining the joining of the distal end portions of the flexible band member 22, and thus the diametric size of the proximal opening 41. For instance, when the training aid apparatus is to be initially attached to the swimmer, as mentioned above, the lock device 23 is adjusted to cooperate with the opposed end portions 40, 40' of the flexible band member 22. Once adjusted, the lock device 23 is configured to retain the material sheath 25 at the selected diametric size suitable to fit the band member 22 comfortably around the bottom portion of the swimmer's leg, but small enough such that the band member 22 will not slip past their ankle during use.

As best illustrated in FIG. 9, the lock device 23 includes a simplistic locking plate member 42 that defines a pair of receiving channels 43 extending therethrough. Each receiving channel 43 is diametrically sized for snug sliding receipt of a transverse cross-sectional dimension of the tubular band member 22, in a radially stretched or tensioned condition, and for selective frictional retainment thereof, in a non-longitudinally tensioned condition.

By way of example, for a rubber tubing band member 22, having an outer diameter in the range of about ⅜ in. and an inner diameter in the range of about ¼ in., a polymeric plate member 42 may be provided, having a thickness in the range about ⅛ in. to about 1 in. The diameter of the receiving channel is to be substantially smaller than the selected rubber tubing, in its natural state, having a diameter in the range of about ⅛ in. to about 1 in. Accordingly, the band member 22 is essentially friction fit within the respective receiving channel 43 until at least one side of the retained band member 22 selectively pulled, stretching the retained portion of the resilient band member until its diametric size thereof is sufficiently contracted to enable sliding receipt through the channel. Upon release of the band member toward the non-tensioned condition, the retained portion thereof expands into frictional retaining contact with the walls of the respective receiving channel.

The locking plate member 42 is at least semi-rigid, and is preferably composed of a polymer material such as a polycarbonate. Other suitable materials include metallic materials such as steel or titanium. It will further be appreciated that any conventional form of lock device can be incorporated that is capable of releasably retaining the distal end portions of the band member 22 together.

Although the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A method for increasing the water resistance for a swimmer's leg during a swimming motion, said method comprising:

providing a swim training aid apparatus having a flexible, resilient band member configured to extend substantially circumferentially around the swimmer's ankle, and a substantially non-absorbent, flexible material sheath defining a communication passage therethrough extending from a proximal opening at one end thereof, mounted to said band member, to a distal opening at an opposite end thereof, said distal opening further being circumferentially substantially larger than that of said proximal opening, said flexible material sheath of a length such that said opposite end thereof extending distally past and terminating beyond said foot when said swimmer is swimming;

placing a foot from the swimmer into said communication passage of the material sheath such that said band member and said proximal opening are oriented around an ankle of the foot; and increasing the water resistance on the leg of the swimmer during said swimming motion when said opposite end of the material sheath extends distally past and terminates beyond said foot.

2. The method according to claim 1, further including:

adjusting the diameter of the proximal opening using a lock device that cooperates with the band member, releasably retaining the same around the swimmer's ankle.

* * * * *